US007451976B2

(12) United States Patent
Nam

(10) Patent No.: US 7,451,976 B2
(45) Date of Patent: Nov. 18, 2008

(54) MEDIA PICKUP APPARATUS FOR MEDIA DISPENSER

(75) Inventor: Sun-Woo Nam, Seoul (KR)

(73) Assignee: LG N-Sys Inc., Seoul (KR)

( * ) Notice: Subject to any disclaimer, the term of this patent is extended or adjusted under 35 U.S.C. 154(b) by 237 days.

(21) Appl. No.: 11/006,545

(22) Filed: Dec. 8, 2004

(65) Prior Publication Data

US 2005/0189708 A1 Sep. 1, 2005

(30) Foreign Application Priority Data

Dec. 26, 2003 (KR) ..... 10-2003-0097717

(51) Int. Cl.
*B65H 1/18* (2006.01)

(52) U.S. Cl. ..... 271/152; 271/153; 271/154

(58) Field of Classification Search ..... 271/149, 271/150, 153, 157, 110, 126, 152; 221/14, 221/154, 17, 198, 287, 162, 187, 186, 197
See application file for complete search history.

(56) References Cited

U.S. PATENT DOCUMENTS

| | | | | |
|---|---|---|---|---|
| 3,759,509 | A * | 9/1973 | Peterson | 271/150 |
| 4,302,000 | A * | 11/1981 | Frank | 271/150 |
| 4,447,097 | A * | 5/1984 | Lafevers et al. | 312/215 |
| 4,980,543 | A | 12/1990 | Hara et al. | |
| 5,848,786 | A * | 12/1998 | Holland-Letz et al. | 271/110 |
| 6,032,946 | A * | 3/2000 | Marshall et al. | 271/152 |

FOREIGN PATENT DOCUMENTS

| | | |
|---|---|---|
| DE | 33 34 522 A1 | 3/1984 |
| DE | 39 09 637-A 1 | 10/1989 |
| JP | 59-074841 | 4/1984 |
| JP | 64-002943 | 1/1989 |
| JP | 4-333432 A | 11/1992 |
| JP | 07-137858 | 5/1995 |
| JP | 09-110188 | 4/1997 |
| JP | 10-087087 | 4/1998 |
| JP | 2000-001242 | 1/2000 |
| JP | 2001-106355 | 4/2001 |
| JP | 2001-310835 A | 11/2001 |

* cited by examiner

*Primary Examiner*—Kaitlin S Joerger
(74) *Attorney, Agent, or Firm*—Birch, Stewart, Kolasch & Birch, LLP

(57) ABSTRACT

A media pickup apparatus includes a push plate for pushing media stored in a cassette body towards a discharge port of the cassette body. A driving source provides power to the push plate so as to allow the push plate to push the media towards the discharge port of the cassette body. A pickup roller is rotatably coupled to one side of a roller bracket and biased towards the push plate by means of an elastic member in such a manner that the pickup roller elastically makes contact with the media pushed by the push plate, in order to discharge the media from a media cassette by separating the media sheet by sheet. A sensor detects a position of the pickup roller so as to provide data for operating the driving source. The media make contact with the pickup roller with a substantially constant contact force so that media are reliably discharged from the media cassette sheet by sheet.

14 Claims, 6 Drawing Sheets

Related Art

MEDIA PICKUP APPARATUS FOR MEDIA DISPENSER

This application claims the priority benefit of Patent Application No. P03-097717 filed on Dec. 26, 2003 in Republic of Korea, which is hereby incorporated by reference.

BACKGROUND OF THE INVENTION

1. Field of the Invention

The present invention relates to a media dispenser. More particularly, the present invention relates to a media pickup apparatus for a media dispenser, capable of discharging stored media from a media cassette by separating the media sheet by sheet.

2. Description of the Related Art

In the present specification, the term "media" refers to sheets of material, such as bank notes, checks, tickets, certificates, etc. The term "media dispenser" refers to an apparatus which automatically supplies such media according to a customer's demand.

FIG. 1 shows a media cassette 1 and a structure for drawing media out of the media cassette 1, which are employed in an automatic media dispenser, in accordance with the related art. The media cassette 1 is installed in the automatic media dispenser. Herein, the media cassette 1 may be either integrated with, or separately formed from, the automatic media dispenser.

Media m are arranged and stacked in the media cassette 1. In the media cassette 1, the media m are pushed toward a discharge port by a push plate 3, so that they are located in tight contact with each other. The push plate 3 is biased or supported by a spring 5 so as to push the media. The spring 5 provides an elastic force which enables the push plate 3 to push the media.

Each sheet of the media, pushed toward the discharge port by the push plate 3, comes into tight contact with a pickup roller 7 before passing through the discharge port. The pickup roller 7 is located at one end of the media cassette 1, comes into contact with and separates each sheet of the media in the media cassette 1, and then moves the separated sheet out of the media cassette 1. The pickup roller 7 may be formed either integrally with the media cassette 1, or separately from the media cassette 1, in the automatic media dispenser.

A feed roller 9 and a contra-roller 10 are disposed close to and opposed to, each other, so as to promote separation of each sheet of the media from another stacked sheet and to transfer the separated sheet. That is, the media are separated and transferred one sheet at a time by the feed roller 9 and the contra-roller 10, while each sheet passes through a gap between the feed roller 9 and the contra-roller 10 rotating in the same direction. Each sheet of the media having passed through the gap between the feed roller 9 and the contra-roller 10 is transferred by a feed roller or a belt provided at a delivery module (not shown).

However, the aforementioned related art has the following drawbacks. The contact force of the media m against the pickup roller 7 caused by the push plate 3 may vary depending on an amount of media m stored in the media cassette 1. Accordingly, a frictional force between the media m and the pickup roller 7 can vary depending on the amount of media m stacked in the media cassette. Because of the varying frictional force, often the pickup roller 7 cannot precisely pick the media m up, sheet by sheet. In addition, if the spring providing the elastic force for biasing the push plate 3 towards the pickup roller 7 has a fault due to a long-term usage thereof, or if an original elastic force of the spring changes due to external or internal factors thereof, a performance of the pickup roller 7 in singularly picking up sheets of media may be deteriorated.

SUMMARY OF THE INVENTION

Accordingly, the present invention is conceived to solve one or more of the aforementioned drawbacks in the related art. An object of the present invention is to provide a media pickup apparatus for a media dispenser, capable of constantly maintaining a relatively stable frictional force between media and a pickup roller.

According to an aspect of the present invention for achieving the object, there is provided a media pickup apparatus for a media dispenser, the media pickup apparatus comprising a push plate for pushing media stored in a cassette body towards a discharge port of the cassette body, a driving source for providing power to the push plate so as to allow the push plate to push the media towards the discharge port of the cassette body, a pickup roller rotatably coupled to one side of a roller bracket, which applies bias force towards the push plate by means of an elastic member in such a manner that the pickup roller elastically makes contact with the media pushed by the push plate, in order to discharge the media from a media cassette by separating the media sheet by sheet, and a sensor detecting a position of the pickup roller so as to provide data for operating the driving source.

According to an embodiment of the present invention, the driving source includes a motor capable of transferring driving force to the push plate through a belt unit.

The driving force of the driving source is transferred to the push plate through a belt unit.

The belt unit selectively transfers the driving force of the driving source to the push plate, and includes a driving pulley driven by the driving source, a driven pulley corresponding to the driving pulley, and a timing belt connected to the push plate and wound around the driving pulley and the driven pulley.

The driving force of the driving source is selectively transferred to the driving pulley according to an opening/closing state of a cassette cover of the cassette body.

The pickup roller is installed around a roller shaft, such that the pickup roller rotates about the roller shaft and both ends of the roller shaft are rotatably coupled to front ends of respective roller brackets, which rotate about a feed shaft.

A detecting slot is formed at one side of the roller bracket in order to allow the sensor to detect the position of the pickup roller.

An extension section is formed at one side of the roller bracket remote from a rotational center of the roller bracket and the detecting slot is formed in the extension section.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Hereinafter, preferred embodiments of a media pickup apparatus for a media dispenser, according to the present invention, will be described with reference to the accompanying drawings.

Figure 1:
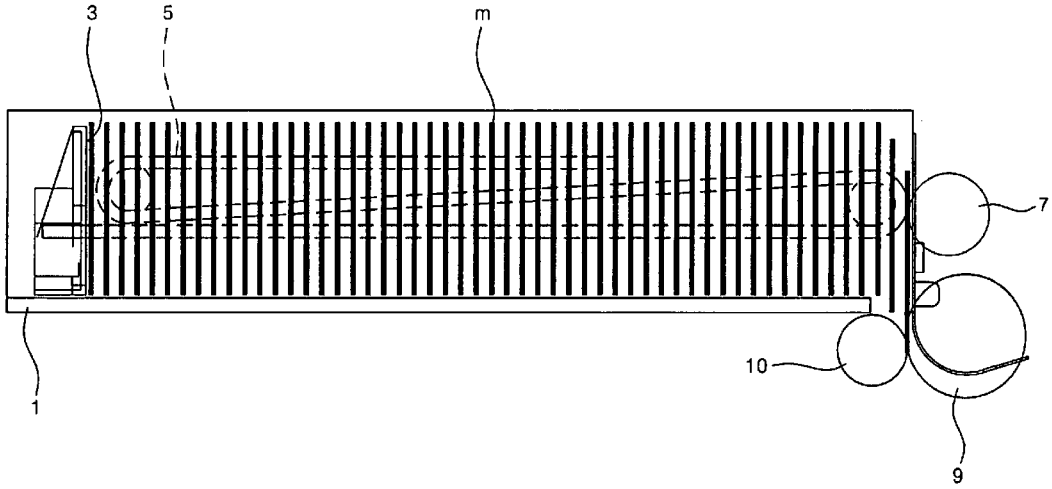
FIG. 1 is a view showing a structure of a media pickup apparatus for a media disperser, in accordance with the related art.
Figure 2:
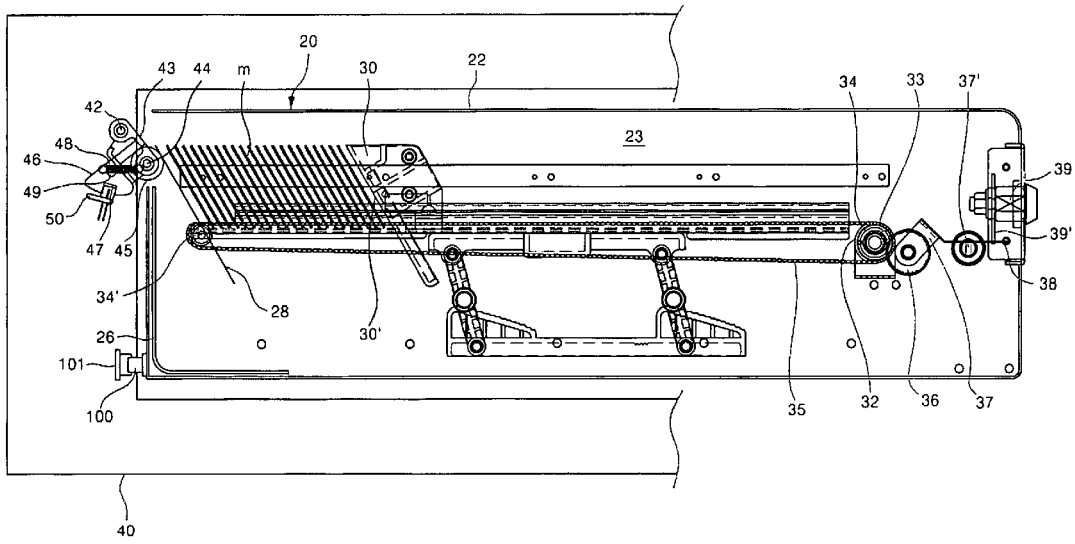
FIG. 2 is a schematic sectional view showing internal parts of a media dispenser equipped with a media pickup apparatus, according to one embodiment of the present invention.
Figure 3:
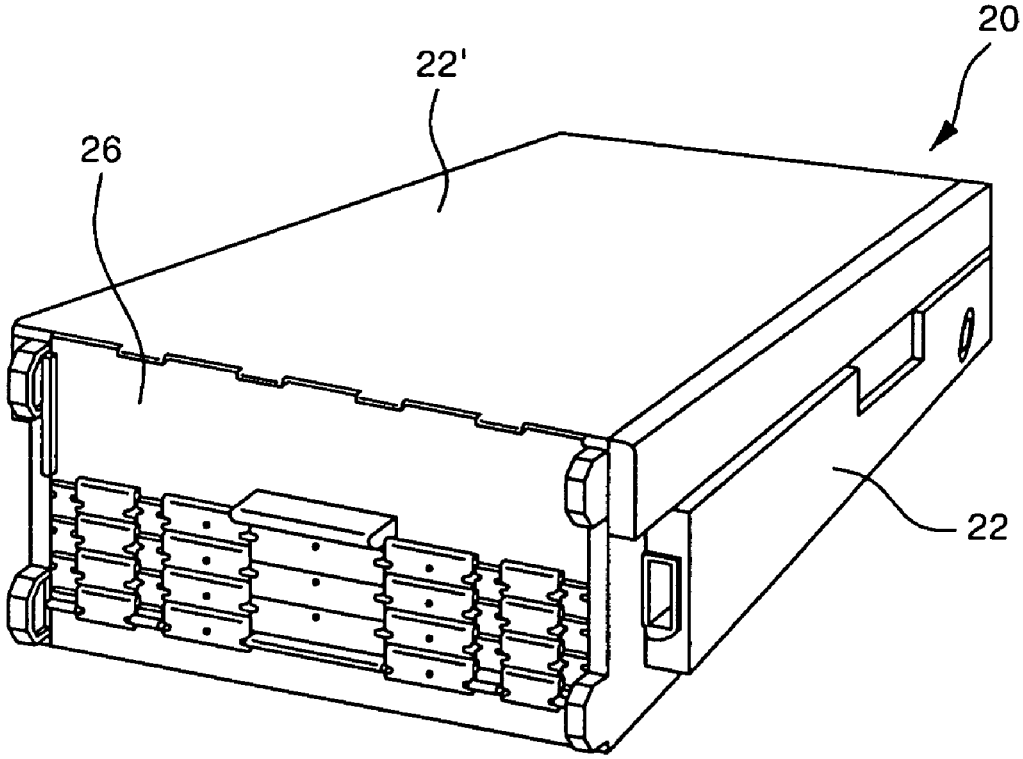
FIG. 3 is a perspective view showing a structure of a media cassette, according to one embodiment of the present invention.
Figure 4:
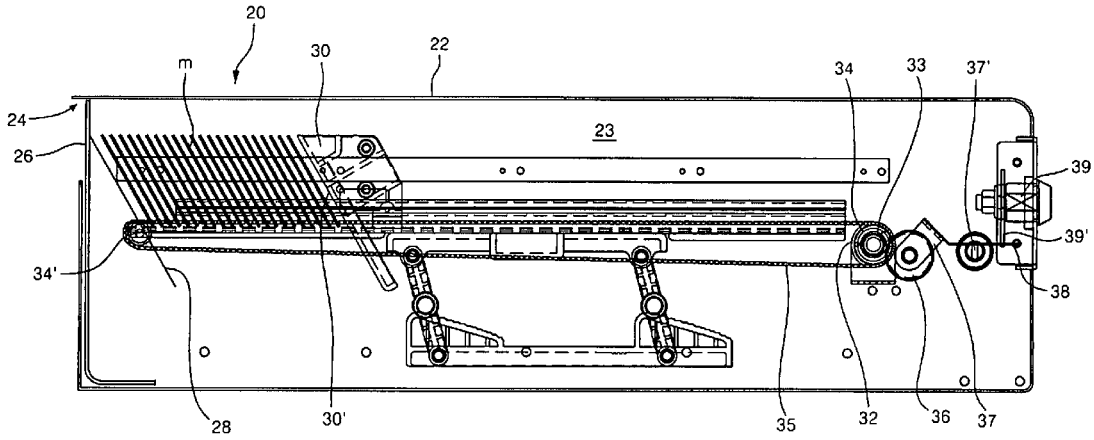
FIG. 4 is a schematic sectional view showing a structure of a media cassette, according to one embodiment of the present invention.

FIG. 2 is a schematic sectional view showing internal parts of a media dispenser 40 equipped with the media pickup apparatus, according to one embodiment of the present invention. FIG. 3 is a perspective view showing a structure of a media cassette 20, according to one embodiment of the present invention. FIG. 4 is a schematic sectional view showing the media cassette 20 according to one embodiment of the present invention.

Referring to FIGS. 2 to 4, the media cassette 20 has a plurality of media m, and is installed in the media dispenser 40 in order to provide the media m at a request of consumers. A cassette body 22 forms an outer appearance of the media cassette 20 and a cassette cover 22' forms an upper surface of the cassette body 22. The cassette body 22 is formed at an inner portion thereof with a storage space 23 for storing the media m therein. An upper portion of the storage space 23 is opened/closed by means of the cassette cover 22'.

The cassette body 22 is formed at a front end thereof with a discharge port 24. The discharge port 24 is a passage for guiding the media m stacked in the cassette body 22 into a conveying path of the media dispenser 40. The discharge port 24 is selectively opened/closed by means of a door 26. The door 26 may automatically open the discharge port 24 if the media cassette 20 is installed in the media dispenser 40. Otherwise, the door 26 closes the discharge port 24. The door 26 can be formed with various structures, so a detailed description thereof will be omitted below.

An inclined guide section 28 is provided in order to guide the media m towards the discharge port 24 of the cassette body 22. The inclined guide section 28 is inclined by a predetermined angle in such a manner that the inclined guide section 28 can guide both ends of the media m. A pickup roller 45, which will be described below in detail, can make contact with the media m through an open middle part of the inclined guide section 28.

A push plate 30 is installed in the cassette body 22. The push plate 30 pushes the media m stored in the storage space 23, towards the inclined guide section 28. A front surface of the push plate 30 forms an inclined surface 30', which is inclined at a predetermined angle approximately equal to an inclined angle of the inclined guide section 28.

Figure 5:
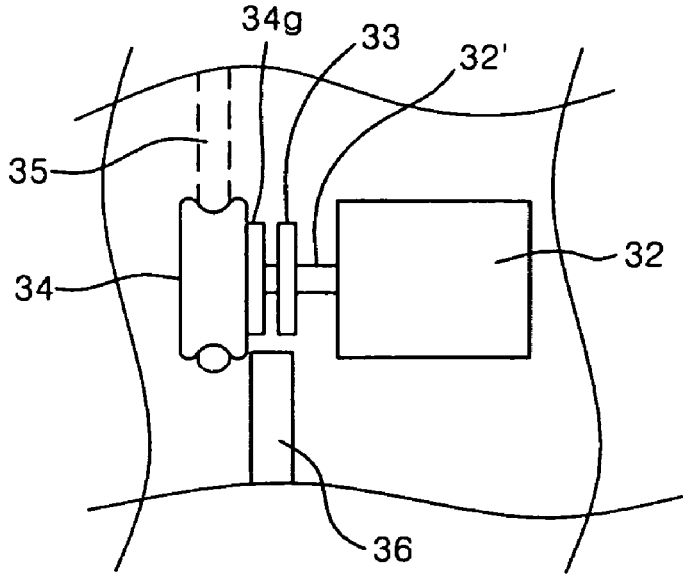
FIG. 5 is a schematic plan view showing a belt motor and a driving pulley, according to one embodiment of the present invention.

Hereinafter, a structure for applying a pushing force to the media m through the push plate 30 will be described with reference to FIGS. 4 and 5. The cassette body 22 has a belt motor 32, which may be an electric motor. A driving gear 33 is coupled to a driving shaft 32' of the belt motor 32. A driving pulley 34 is installed adjacent to the driving gear 33. Although a driving shaft of the driving gear 33 is not directly coupled to a driving shaft of the driving pulley 34, it is preferred that the driving shafts of the driving gear 33 and the driving pulley 34 are arranged in line or co-axial with each other. The driving pulley 34 is integrally formed with a pulley gear section 34*g*. The driving pulley 34 and the pulley gear section 34*g* are coaxially aligned and rotated together.

A driven pulley 34' is provided at an inner front end of the cassette body 22 corresponding to the driving pulley 34. The driven pulley 34' is connected to the driving pulley 34 through a timing belt 35, which is wound around the driven pulley 34' and the driving pulley 34. In addition, the push plate 30 is connected to one side of the timing belt 35. Accordingly, the push plate 30 is moved within the cassette body 22 when the timing belt 35 is driven.

A clutch gear 36 is installed between the pulley gear section 34*g* of the driving pulley 34 and the driving gear 33 for the purpose of power transmission therebetween. The clutch gear 36 is engaged with both the pulley gear section 34*g* and driving gear 33 in the same gear ratio for the purpose of power transmission. Accordingly, the driving gear 33 and the driving pulley 34 may rotate in the same direction by means of the clutch gear 36.

The clutch gear 36 has a thickness sufficient for simultaneously engaging with both driving gear 33 and pulley gear section 34*g*. The clutch gear 36 is rotatably mounted on a clutch plate 37. In addition, the clutch gear 36 is installed in the cassette body 22 in such a manner that the clutch plate 37 may rotate about a rotational center 37'.

An engagement section 38 extends from an end of the clutch plate 37 in opposition to the clutch gear 36. The engagement section 38 and the clutch gear 36 may perform a seesaw movement about the rotational center 37'.

A locking key 39 is provided at one side of the cassette body 22. The locking key 39 is used for coupling the cassette cover 22' to the cassette body 22. The locking key 39 is provided at an inner portion thereof with a key cam 39', which is rotated when the locking key 39 performs locking/unlocking operations. The key cam 39' has an eccentric structure so that a distance between a rotational center of the locking key 39 and an outer peripheral portion of the key cam 39' is variously formed. In addition, the outer peripheral portion of the key cam 39' makes contact with the engagement section 38. Therefore, as the locking key 39 rotates, the engagement section 38 makes contact with the key cam 39' at various contact points of the outer peripheral portion of the key cam 39' while rotating the clutch plate 37 about the rotational center 37'.

At this time, a spring can be additionally used in order to allow the clutch plate 37 to rotate about the rotational center 37'. That is, in order to facilitate the rotation of the clutch plate 37 according to variation of contact points of the key cam 39' with respect to the engagement section 38, the clutch plate 37 is elastically supported by the spring.

Figure 6:
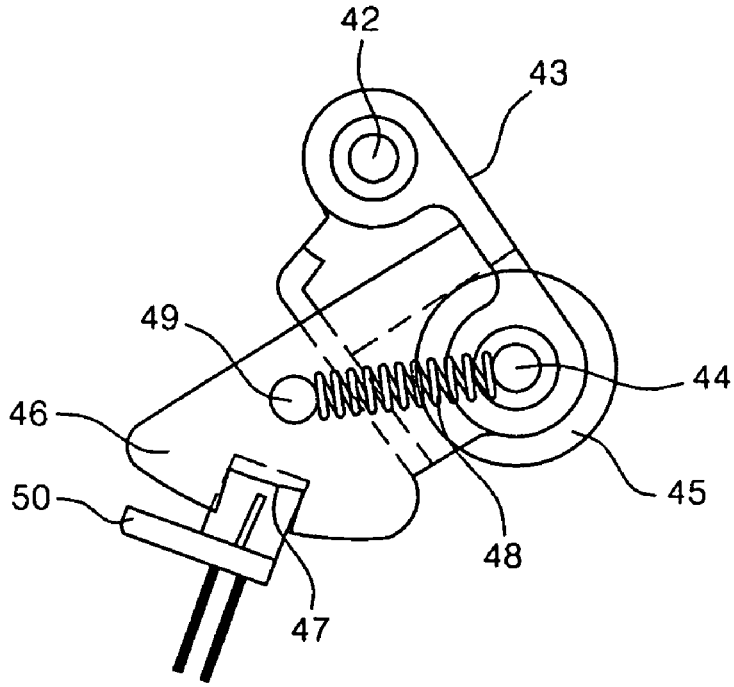
FIG. 6 is a schematic view showing a pickup roller and a sensor according to one embodiment of the present invention.

Hereinafter, a description will be made of a structure for discharging the media m stored in the cassette body 22 sheet by sheet. As shown in FIGS. 2 and 6, parts capable of discharging the media m stored in the cassette body 22 by separating the media m sheet by sheet are provided in the media dispenser 40 in the vicinity of the media cassette 20.

A roller bracket 43 is rotatably installed around both ends of a feed shaft 42 such that the roller shaft 43 may rotate about the feed shaft 42. A front end of the roller bracket 43 is connected to a roller shaft 44. The roller bracket 43 may rotate by a predetermined angle about the feed shaft 42. A pickup unit, such as a pickup roller 45, is installed around the roller shaft 44 such that the pickup roller 45 rotates about the roller shaft 44. The pickup roller 45 is used in order to separate the media m stored in the cassette body 22 sheet by sheet. The number of the pickup rollers 45 may vary depending on a width of the media m, and the pickup roller 45 is driven by means of a driving motor (not shown).

An extension section 46 is formed at one side of the roller bracket 43 and a detecting slot 47 is formed in the extension section 46. It is preferred that a position of the detecting slot 47 in the extension section 46 is distanted from the feed shaft 42, which is a rotational center of the roller bracket 43. In such a case, it is possible to precisely detect a rotational degree of the roller bracket 43. The detecting slot 47 allows a sensor 50, which will be described below in detail, to detect the position of the pickup roller 45.

Meanwhile, the roller bracket 43 is connected to one end of a spring 48 so as to apply bias force to the pickup roller 45 towards the push plate 30. That is, the spring 48 biases the pickup roller 45 towards the push plate 30 such that the pickup roller 45 makes contact with the media m. The other end of the spring 48 is connected to a support shaft 49. Accordingly, the pickup roller 45 makes contact with the media m by means of a biasing force of the spring 48 applied to both ends of the pickup roller 45.

A sensor 50 fixed relative to the media dispenser 40 is provided at a position corresponding to the position of the detecting slot 47. The sensor 50 detects whether or not the pickup roller 45 is in a predetermined position allowing the pickup roller 45 to make contact with the media m with proper contact force. The sensor 50 includes a light emitting device and a light receiving device located on respective sides of the extension section 46. The sensor 50 detects the predetermined position of the pickup roller 45 by checking whether or not light radiated from the light emitting device is received in the light receiving device. That is, if the light receiving device receives light radiated from the light emitting device through the detecting slot 47, it is determined that the pickup roller 45 is aligned in the proper position with respect to the media m. Alternatively, the sensor 50 could be a metal or magnet sensor, and a piece of metal or magnet could be attached to the roller bracket 43 where the detecting slot 47 would have been.

Hereinafter, the operation of the media pickup apparatus for the media dispenser according to the present invention configured as above will be described in detail.

In a state in which the media cassette 20 is separated from the media dispenser 40, the cassette cover 22' is opened so as to store the media m in the storage space 23. That is, the cassette cover 22' is opened by unlocking the locking key 39, and the media m are stacked between the push plate 30 and the inclined guide section 28 formed in the storage space 23. It is preferred to stack the media m in the storage space 23 after moving the push plate 30 towards the driving pulley 34. Generally, if the media m have been mostly discharged, the push plate 30 is positioned adjacent to the inclined guide section 28.

When the cassette cover 22' is opened, a user may manually move the push plate 30 from the inclined guide section 28 to the driving pulley 34. At this time, the engagement of the clutch gear 36 with respect to the driving gear 33 of the belt motor 32 and the pulley gear section 34*g* of the driving pulley 34 has been released. This is because the engagement section 38 makes contact with a contact point of the outer peripheral portion of the key cam 39' positioned adjacent to the rotational center of the locking key 39, so the clutch plate 37 has been relatively rotated counterclockwise about the rotational center 37'. Therefore, the clutch gear 36 is not engaged with the driving gear 33 and the pulley driving section 34*g*.

Alternatively, the clutch plate 37 can be shaped to be directly engaged by the cassette door, such that the clutch gear 36 connects the driving gear 33 and pulley gear section 34*g* when the cassette door is closed. When the cassette door is opened, the door no longer bears against the clutch plate 37. Hence, the clutch plate 37 will tend to move, e.g. via a spring or elastic bias, to a position where the clutch gear 36 no longer engages the driving gear 33 and pulley gear section 34*g*. Hence, the elements 37' and 38 may be eliminated.

In such an unlocking state of the locking key 39, the driving pulley 34 is not coupled to the belt motor 32, so a load or turning force is not applied to the belt motor 32 if a worker moves the push plate 30. Therefore, the worker can stack the media m in the storage space 32 while freely moving the push plate 30.

After stacking the media m in the storage space 23, the cassette cover 22' is closed and the locking key 39 is locked. As the locking key 39 rotates, the key cam 39' integrally formed with the locking key 39 is rotated together with the locking key 39, so a contact point of the outer peripheral portion of the key cam 39', which is relatively remote from the rotational center of the locking key 39, makes contact with the engagement section 38, thereby rotating the clutch plate 37. Accordingly, the clutch gear 36, installed on the clutch plate 37, is engaged with both the driving gear 33 and the pulley gear section 34*g*, so power transmission may be realized between the driving gear 33 and the pulley gear section 34*g*.

When the media cassette 20 has been installed in the media dispenser 40, the door 26 is opened and the pickup roller 45 makes contact with the media m rested on the inclined guide section 28 due to bias force of the spring 48 pushing the pickup roller 45 towards the push plate 30.

Figure 7A:
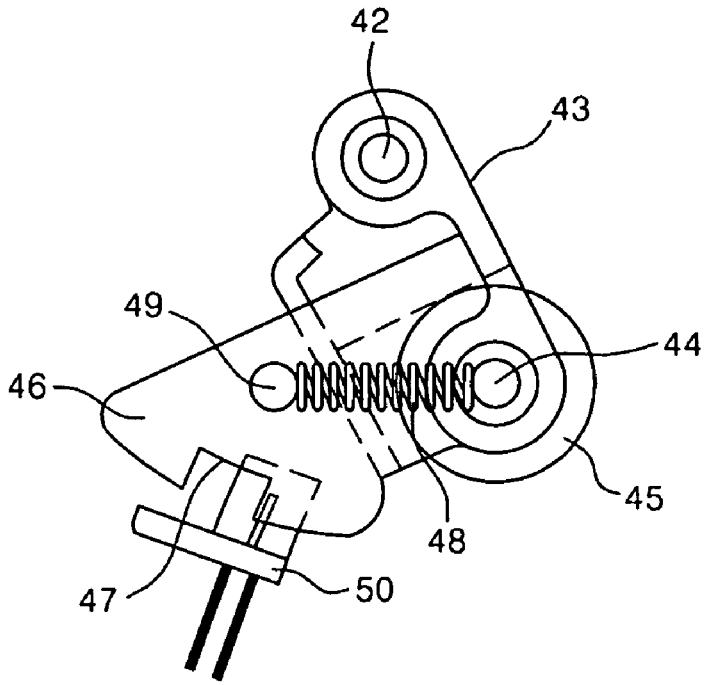
FIGS. 7*a* and 7*b* are operational views of the pickup roller and the sensor, according to one embodiment of the present invention.
Figure 7B:
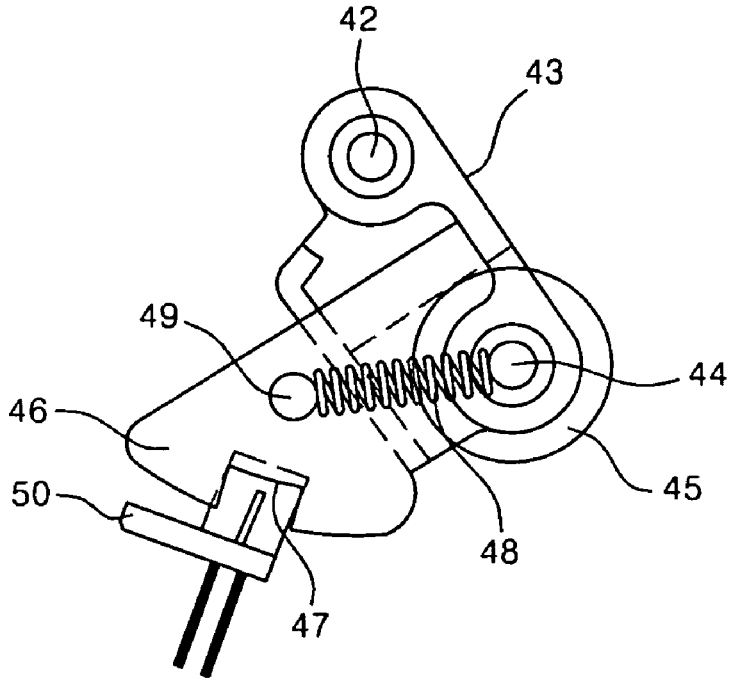

Meanwhile, in order to allow the pickup roller 45 to make contact with the media m with a predetermined contact force, the sensor 50 is operated. For example, as shown in FIG. 7*a*, if light radiated from the light emitting device of the sensor 50 is shielded by the extension section 46, so the light is not received in the light receiving device, it is determined that the pickup roller 45 does not precisely make contact with the media m. In other words, the pressure of the pickup roller 45 is too light against the media m. In this case, the belt motor 32 is driven in order to increase the pushing force of the push plate 30 applied to the media m.

The roller bracket 43 can be rotated by a predetermined angle about the feed shaft 42 if the pushing force of the push plate 30 applied to the media m is changed by driving the belt motor 32. Accordingly, the position of the pickup roller 45 will change as the push plate 30 moves.

Such an operation may be continued until the light receiving device receives the light radiated from the light emitting device of the sensor 50 through the detecting slot 47. If the light receiving device receives the light radiated from the light emitting device of the sensor 50 through the detecting slot 47, it is determined that the pickup roller 45 precisely makes contact with the media m, so that the media m are ready to be discharged from the media cassette 20.

The detecting operation of the sensor 50 for the pickup roller 45 is repeatedly carried out while the media dispenser 40 is being operated. This is because contact force of the media m with respect to the pickup roller 45 changes as the number of the media m stored in the media cassette 20 decreases as a result of discharge of the media m. Accordingly, the belt motor 32 is repeatedly driven in order to move the push plate 30, such that the pickup roller 45 makes contact with the media m with proper contact force as the number of remaining media changes.

That is, the sensor 50 detects the position of the detecting slot 47 and continuously sends data to a control unit. In addition, the belt motor 32 is driven based on the data transmitted from the sensor 50 so that the push plate 30 is moved while applying pushing force to the media m, thereby allowing the media m to make contact with the pickup roller 45 with a proper contact force. The data sent by the control unit to the belt motor 32 could be sent by a wireless RF signal, infrared signal, or more preferably through a first connector 100 attached to the exterior of the cassette body 22, which mates with a second connector 101 attached inside the media dispenser.

Although a preferred embodiment of the present invention has been described for illustrative purposes, those skilled in the art will appreciate that various modifications, additions and substitutions are possible, without departing from the scope and spirit of the invention as disclosed in the accompanying claims.

For example, the clutch gear 36 of the present invention has been illustrated and described as being aligned between the belt motor 32 and the driving pulley 34 for selectively transferring power according to the operational state of the locking key 39. However, the clutch gear 36 could be any structure capable of selectively transferring power, as the cassette cover 22' is opened or closed.

According to the present invention, the following advantages can be obtained. The media can be precisely discharged from the media cassette of the media dispenser by separating the media sheet by sheet. The push plate can apply various pushing force to the media based on data detected by the sensor, in such a manner that media can make contact with the pickup roller with constant contact force. Accordingly, the media can be precisely discharged from the media cassette sheet by sheet.

Further, since the push plate receives power from the belt motor when applying pushing force to the media, a contact force of the media with respect to the pickup roller can be maintained at a predetermined value even if the media dispenser is used for a long period of time. Accordingly, the reliability of the media dispenser can be improved and a performance of the media dispenser can be constantly maintained for a long period of time.

The scope of the present invention is not limited by the illustrated embodiments but defined by the appended claims. It will be apparent that those skilled in the art can make various modifications and changes within the scope of the invention defined by the claims.

What is claimed is:

1. A media pickup apparatus for a media dispenser, said media pickup apparatus comprising:

a bracket movable toward a discharge opening of a media cassette;

a pickup unit coupled to said bracket, said pickup unit being capable of removing sheets of media, sheet-by-sheet, from the discharge opening of the media cassette;

a biasing member applying a biasing force tending to move said pickup unit toward the discharge opening of the media cassette; and a sensor detecting a position of said pickup unit relative to the discharge opening of the media cassette, wherein said sensor provides a signal indicative of a position of said pickup unit, wherein said sensor includes a light transmitter and a light receiver, wherein the bracket includes a main section that is configured to be disposed substantially parallel to the sheets of media in the discharge opening of the media cassette, wherein a rotational degree detecting slot is formed in an end of the extension section that is away from the main section, and allows light from said light transmitter to pass therethrough and be received by said light receiver, when said bracket is in a predetermined position relative to the discharge opening of the media cassette such that a rotational degree of the main section of the bracket is detected, and wherein the biasing member extends from a portion of the extension section towards a center of the pickup unit, and thereby applies the biasing force in a direction towards the center of the pickup unit.

2. The media pickup apparatus according to claim 1, wherein said pickup unit is a pickup roller rotatably coupled to said bracket.

3. The media pickup apparatus according to claim 2, wherein said bracket is rotatably mounted to the media dispenser, and wherein said pickup roller is rotatably mounted to said bracket along a first axis which is distanced from a second axis defining the rotatably mounting between said bracket and said modia dispenser.

4. The media pickup apparatus according to claim 1, wherein said biasing member includes a spring.

5. The media pickup apparatus according to claim 1, further comprising:

a controller for receiving the signal from said sensor, wherein the signal from said sensor indicates that said pickup unit has moved a predetermined distance toward the discharge opening of the media cassette, in response said controller sending a signal to the media cassette to move stacked media therein toward the discharge opening and said pickup unit.

6. A media cassette for a media dispenser, said media cassette comprising:

a cassette body having a discharge opening;

a push plate inside said cassette body for pushing a stack of media stored in said cassette body toward said discharge opening of said cassette body; and a driving source for moving said push plate toward said discharge opening of said cassette body, wherein said driving, source includes a motor, a belt unit transmitting power from said motor to move said push plate, a driving pulley or gear driven by said motor and a driven pulley or gear which is connected to said driving pulley or gear by said belt unit, and wherein a portion of said belt unit is connected to said push plate, wherein said cassette body includes an access cover, which can be opened and closed to insert media into, or remove media from, said cassette body, and:

wherein the media cassette further includes:

a clutch located between said motor and said driving pulley or gear to allow for selectively connecting a driving force of said motor to said driving pulley or gear; and a link which causes said clutch to disengage said motor from said driving pulley or gear when said access cover is opened, so that an operator can manually move said push plate.

7. The media cassette according to claim 6, further comprising:

a door for opening and closing said discharge opening.

8. The media cassette according to claim 6, further comprising:

a ramp located adjacent to said discharge opening of said cassette body, which assists media in being delivered to said discharge opening, wherein said push plate is angled at an angle corresponding to an incline of said ramp.

9. A media dispenser comprising:

a cassette body having a discharge opening;

a push plate inside said cassette body for pushing a stack of media stored in said cassette body toward said discharge opening of said cassette body;

a driving source for moving said push plate toward said discharge opening of said cassette body;

a bracket movable toward said discharge opening of said cassette body;

a pickup unit coupled to said bracket, said pickup unit being capable of removing sheets of media, sheet-by-sheet, from said discharge opening of said cassette body;

a biasing member applying a biasing force tending to move said pickup unit toward said discharge opening of said cassette body; and a sensor detecting a position of said pickup unit relative to said discharge opening of said cassette body, wherein said sensor provides a signal indicative of a position of said pickup unit, wherein said sensor includes a light transmitter and a light receiver, wherein the bracket includes a main section that is configured to be disposed substantially parallel to the sheets of media stored in the cassette, and wherein a rotational degree detecting slot is formed in an end of the extension section that is away from the main section, and allows light from said light transmitter to pass therethrough and be received by said light receiver, when said bracket is in a predetermined position relative to the discharge opening of the cassette body such that a rotational degree of the main section of the bracket is detected, and wherein the biasing member extends from a portion of the extension section towards a canter of the pickup unit, and thereby applies the biasing force in a direction towards the center of the pickup unit.

10. The media dispenser according to claim 9, further comprising:

a first electrical connector attached to said cassette body which mates with a second electrical connector attached to said media dispenser when said cassette body is inserted into said media dispenser, wherein said driving source is controlled by a signal sent through said first and second connectors.

11. The media dispenser according to claim 9, further comprising:

a controller for receiving the signal from said sensor, wherein the signal from said sensor indicates that said pickup unit has moved a predetermined distance toward said discharge opening of said cassette body, in response said controller sending a signal to said driving source to move stacked media in said cassette body toward said discharge opening and said pickup unit.

12. The media dispenser according to claim 9, wherein said pickup unit is a pickup roller rotatably coupled to said bracket, wherein said bracket is rotatably mounted to the media dispenser, and wherein said pickup roller is rotatably mounted to said bracket along a first axis which is distanced from a second axis defining the rotatably mounting between said bracket and said media dispenser.

13. The media dispenser according to claim 9, wherein said driving source includes a motor, a belt unit transmitting power from said motor to move said push plate, a driving pulley or gear driven by said motor and a driven pulley or gear which is connected to said driving pulley or gear by said belt unit, and wherein a portion of said belt unit is connected to said push plate.

14. A media dispenser comprising:

a cassette body having a discharge opening;

a push plate inside said cassette body for pushing a stack of media stored in said cassette body toward said discharge opening of said cassette body;

a driving source for moving said push plate toward said discharge opening of said cassette body;

a bracket movable toward said discharge opening of said cassette body;

a pickup unit coupled to said bracket, said pickup unit being capable of removing sheets of media, sheet-by-sheet, from said discharge opening of said cassette body;

a biasing member applying a biasing force tending to move said pickup unit toward said discharge opening of said cassette body; and a sensor detecting a position of said pickup unit relative to said discharge opening of said cassette body, wherein said sensor provides a signal indicative of a position of said pickup unit, wherein said driving source includes a motor, a belt unit transmitting power from said motor to move said push plate, a driving pulley or gear driven by said motor and a driven pulley or gear which is connected to said driving pulley or gear by said belt unit, wherein a portion of said belt unit is connected to said push plate, and wherein said cassette body includes an access cover, which can be opened and closed to insert media into, or remove media from, said cassette body, and:

wherein the media dispenser further includes:

a clutch located between said motor and said driving pulley or gear to allow for selectively connecting a driving force of said motor to said driving pulley or gear; and a link which causes said clutch to disengage said motor from said driving pulley or gear when said access cover is opened, so that an operator can manually move said push plate.

* * * * *